US009544670B2

(12) United States Patent
Yim et al.

(10) Patent No.: US 9,544,670 B2
(45) Date of Patent: Jan. 10, 2017

(54) COVERED HOUSING

(71) Applicant: Logitech Europe S.A., Morges (CH)

(72) Inventors: David Yim, Vancouver, WA (US); Steve McGarry, Vancouver, WA (US)

(73) Assignee: Logitech Europe S.A., Lausanne (CH)

( * ) Notice: Subject to any disclaimer, the term of this patent is extended or adjusted under 35 U.S.C. 154(b) by 601 days.

(21) Appl. No.: 13/682,565

(22) Filed: Nov. 20, 2012

(65) Prior Publication Data

US 2014/0140556 A1 May 22, 2014

(51) Int. Cl.
*H04R 1/02* (2006.01)
*H04R 9/06* (2006.01)

(52) U.S. Cl.
CPC ..... *H04R 1/023* (2013.01); *H04R 1/021* (2013.01); *Y10T 29/49826* (2015.01)

(58) Field of Classification Search
CPC ..... H04R 1/023; H04R 5/02; H04R 1/025; H04R 1/021; Y10T 29/49828
USPC ..... 381/332, 336, 333, 334, 335, 387, 388, 381/386
See application file for complete search history.

(56) References Cited

U.S. PATENT DOCUMENTS

| | | | | |
|---|---|---|---|---|
| 3,082,839 | A * | 3/1963 | Whitcas | 181/151 |
| 3,804,195 | A * | 4/1974 | Everitt et al. | 181/148 |
| 4,325,455 | A | 4/1982 | Kirkpatrick | |
| 4,503,292 | A | 3/1985 | Johnson et al. | |
| 4,936,410 | A | 6/1990 | Howell | |
| D344,951 | S | 3/1994 | Christie | |
| D349,499 | S | 8/1994 | Collins | |
| 5,400,413 | A | 3/1995 | Kindel | |
| 5,412,162 | A | 5/1995 | Kindel | |
| 5,674,076 | A | 10/1997 | Billings et al. | |
| 5,762,194 | A | 6/1998 | Clegg | |
| D402,660 | S | 12/1998 | Swansey | |
| D421,262 | S | 2/2000 | Warren | |
| 6,096,160 | A | 8/2000 | Kadomura | |
| 6,186,269 | B1 | 2/2001 | Vollmer et al. | |
| 6,345,685 | B1 | 2/2002 | Wells et al. | |
| 6,431,308 | B1 | 8/2002 | Vollmer et al. | |

(Continued)

FOREIGN PATENT DOCUMENTS

CA 2082371 * 5/1994

OTHER PUBLICATIONS

A Bluetooth speaker for the great outdoors, Posting date May 21, 2013, Copyright CBS Interactive Inc. All rights reserved [online], [site visited on Dec. 16, 2013]. <http://reviews.cnet.com/portable-speakers/logitech-ue-boom-blue/4505-11313_7-35765418.html>.

(Continued)

*Primary Examiner* — Vivian Chin
*Assistant Examiner* — Con P Tran
(74) *Attorney, Agent, or Firm* — Kilpatrick Townsend & Stockton LLP

(57) ABSTRACT

One embodiment of the invention is directed to a process for assembly of a covered housing comprising placing a first frame strip coupled with a fabric portion, under a shoulder on a first end of a housing, pulling the fabric portion toward a second end of a housing, placing a second frame strip coupled with the fabric portion, under a shoulder on the second end of the housing, placing a third frame strip coupled with the fabric portion, under a first main body shoulder of the housing, and placing a fourth frame strip coupled with the fabric portion, under a second main body shoulder of the housing.

24 Claims, 22 Drawing Sheets

(56) References Cited

U.S. PATENT DOCUMENTS

| | | | |
|---|---|---|---|
| D483,350 | S | 12/2003 | Chen |
| 6,973,994 | B2 | 12/2005 | Mackin et al. |
| D513,746 | S | 1/2006 | Allen |
| D551,656 | S | 9/2007 | Ritsher et al. |
| D555,636 | S | 11/2007 | Chen et al. |
| D570,826 | S | 6/2008 | Fong |
| D571,359 | S | 6/2008 | Chang |
| D573,579 | S | 7/2008 | Yamaguchi |
| D574,363 | S | 8/2008 | Laituri et al. |
| D583,803 | S | 12/2008 | Lum et al. |
| D588,576 | S | 3/2009 | Son et al. |
| D597,529 | S | 8/2009 | Tan et al. |
| D598,899 | S | 8/2009 | Tkachuk |
| D603,845 | S | 11/2009 | Tkachuk |
| D604,720 | S | 11/2009 | Liu |
| D607,878 | S | 1/2010 | Murray |
| D611,450 | S | 3/2010 | Miyazaki |
| D616,420 | S | 5/2010 | Morimoto |
| D619,119 | S | 7/2010 | Graber |
| D620,475 | S | 7/2010 | Graber |
| D621,386 | S | 8/2010 | Chang |
| 7,787,912 | B2 | 8/2010 | Saila |
| D625,706 | S | 10/2010 | Graber |
| 7,814,583 | B2 | 10/2010 | Lerma |
| D633,898 | S | 3/2011 | Seo et al. |
| D635,552 | S | 4/2011 | Yokoyama |
| D636,379 | S | 4/2011 | Kim et al. |
| D641,340 | S | 7/2011 | Huh |
| D642,159 | S | 7/2011 | Joseph |
| D644,206 | S | 8/2011 | Ponnert |
| D659,120 | S | 5/2012 | Kim et al. |
| D659,675 | S | 5/2012 | Kim et al. |
| D659,677 | S | 5/2012 | Kim et al. |
| D667,389 | S | 9/2012 | Yokoyama |
| D670,271 | S | 11/2012 | Tzeng |
| D674,776 | S | 1/2013 | Cmehil |
| D676,418 | S | 2/2013 | Suzuki |
| D679,678 | S | 4/2013 | Uesugi |
| D680,517 | S | 4/2013 | Khoo et al. |
| D685,349 | S | 7/2013 | Ohno et al. |
| D687,016 | S | 7/2013 | Brunner et al. |
| D687,017 | S | 7/2013 | Ashcraft et al. |
| D687,810 | S | 8/2013 | Son et al. |
| 8,540,855 | B2 | 9/2013 | Hayakawa et al. |
| D691,117 | S | 10/2013 | Silvera |
| D691,587 | S | 10/2013 | Ferber et al. |
| D692,411 | S | 10/2013 | Joseph |
| D692,413 | S | 10/2013 | Holzer |
| D692,860 | S | 11/2013 | Paterson |
| D692,861 | S | 11/2013 | Paterson |
| D693,330 | S | 11/2013 | Lee |
| D693,794 | S | 11/2013 | Nauroy |
| D694,218 | S | 11/2013 | Szymanski |
| D706,743 | S | 6/2014 | Lukic |
| 9,002,041 | B2 | 4/2015 | McGarry |
| 2011/0286613 | A1* | 11/2011 | Lipsky et al. ..... 381/182 |
| 2012/0121924 | A1 | 5/2012 | Miller et al. |

OTHER PUBLICATIONS

Apple Insider: Review: Ultimate Ears Boom Bluetooth portable speaker, Posting date Sunday Dec. 1, 2013, Copyright 2013, AppleInsider.com [online], site visited on Dec. 16, 2013, <http://appleinsider.com/articles/13/12/01/review-ultimate-ears-boom-bluetooth-portable-speaker>.

Notice of Allowance mailed Jan. 17, 2014, issued in Design U.S. Appl. No. 29/437,807, mailed Nov. 20, 2012. 13 pages.

Design U.S. Appl. No. 29/468,185, filed Sep. 26, 2013, by Branko Lukic et al.

Non-Final Office Action, dated Nov. 6, 2015 for Design U.S. Appl. No. 29/468,185, filed Sep. 26, 2013, 15 pages.

* cited by examiner

COVERED HOUSING

BACKGROUND OF THE INVENTION

There are many challenges for assembling fabric to a unique shaped housing. If using a unique speaker housing shape, such as a cylinder shape, it is difficult to create tension in the fabric both vertically and horizontally around the cylindrical shaped component after the fabric is assembled to a cylindrical shape. The tension needs to be high enough so that the fabric cannot simply be pulled off the housing. Accordingly, a traditional sock assembly where a fabric sock that is open on both ends is slipped over a rectangular or cylinder housing would not work because the tension along the length of the sock cannot be well controlled. Moreover, a traditional sock assembly generally requires a cap on each end to mechanically hold the sock in place. If the cap also includes additional features or controls (e.g., buttons, etc.) or connectors, these may be damaged or compromised when applying pressure to fit the cap onto the housing. This creates additional challenges particularly for portable-type speakers that have limited space for controls. Other challenges include how to assemble one piece of fabric to substantially cover the speaker housing without cosmetic issues, such as seams and visible wrinkles.

BRIEF SUMMARY OF THE INVENTION

Embodiments of the invention are directed to a covered housing.

One embodiment of the invention is directed to a process for assembly of a covered housing comprising placing a first frame strip coupled with a fabric portion, under a shoulder on a first end of a housing, pulling the fabric portion toward a second end of a housing, placing a second frame strip coupled with the fabric portion, under a shoulder on the second end of the housing, placing a third frame strip coupled with the fabric portion, under a first main body shoulder of the housing, and placing a fourth frame strip coupled with the fabric portion, under a second main body shoulder of the housing.

Another embodiment of the invention is directed to a speaker comprising a speaker housing for housing speaker components therein. The speaker housing comprising a first end comprising a first shoulder. The speaker housing further comprising a second end comprising a second shoulder. The speaker housing further comprising a main body coupled with the first end and the second end, the main body comprising a first main body shoulder and a second main body shoulder. The speaker further comprising a fabric portion coupled with the speaker housing, the fabric portion comprising a first edge, a second edge, a third edge, and a fourth edge. The fabric portion further comprising a first frame strip coupled with the first edge, a second frame strip coupled with the second edge, a third frame strip coupled with the third edge, and a fourth frame strip coupled with the fourth edge. The fabric portion coupled with the speaker housing via the first frame strip of the fabric portion and the first shoulder of the speaker housing, the second frame strip of the fabric portion and the second shoulder of the speaker housing, the third frame strip of the fabric portion and the first main body shoulder of the speaker housing, and the fourth frame strip of the fabric portion and the second main body shoulder of the speaker housing.

Another embodiment of the invention is directed to a speaker comprising a speaker housing for housing speaker components therein. The speaker housing comprising a first end comprising a first fastening mechanism. The speaker housing further comprising a second end comprising a second fastening mechanism. The speaker housing further comprising a main body coupled with the first end and the second end, the main body comprising a first main body fastening mechanism and a second main body fastening mechanism. The speaker further comprising a fabric portion coupled with the speaker housing, the fabric portion comprising a first edge, a second edge, a third edge, and a fourth edge. The fabric portion further comprising a first frame strip coupled with the first edge, a second frame strip coupled with the second edge, a third frame strip coupled with the third edge, and a fourth frame strip coupled with the fourth edge. The fabric portion coupled with the speaker housing via the first frame strip of the fabric portion and the first fastening mechanism of the speaker housing, the second frame strip of the fabric portion and the second fastening mechanism of the speaker housing, the third frame strip of the fabric portion and the first main body fastening mechanism of the speaker housing, and the fourth frame strip of the fabric portion and the second main body fastening mechanism of the speaker housing.

These and other embodiments are described in further detail below.

DETAILED DESCRIPTION OF THE INVENTION

Embodiments of the invention provide a covered housing that allows fabric to be wrapped around a speaker housing in a way to reach the desired tension. A speaker fabric assembly contains frame strips bonded to the fabric that may be tucked under shoulders of a speaker housing. Once the fabric strips are secured under the shoulders, the fabric is held in tension thereby holding the fabric in the intended position and shape.

Figure 1A:
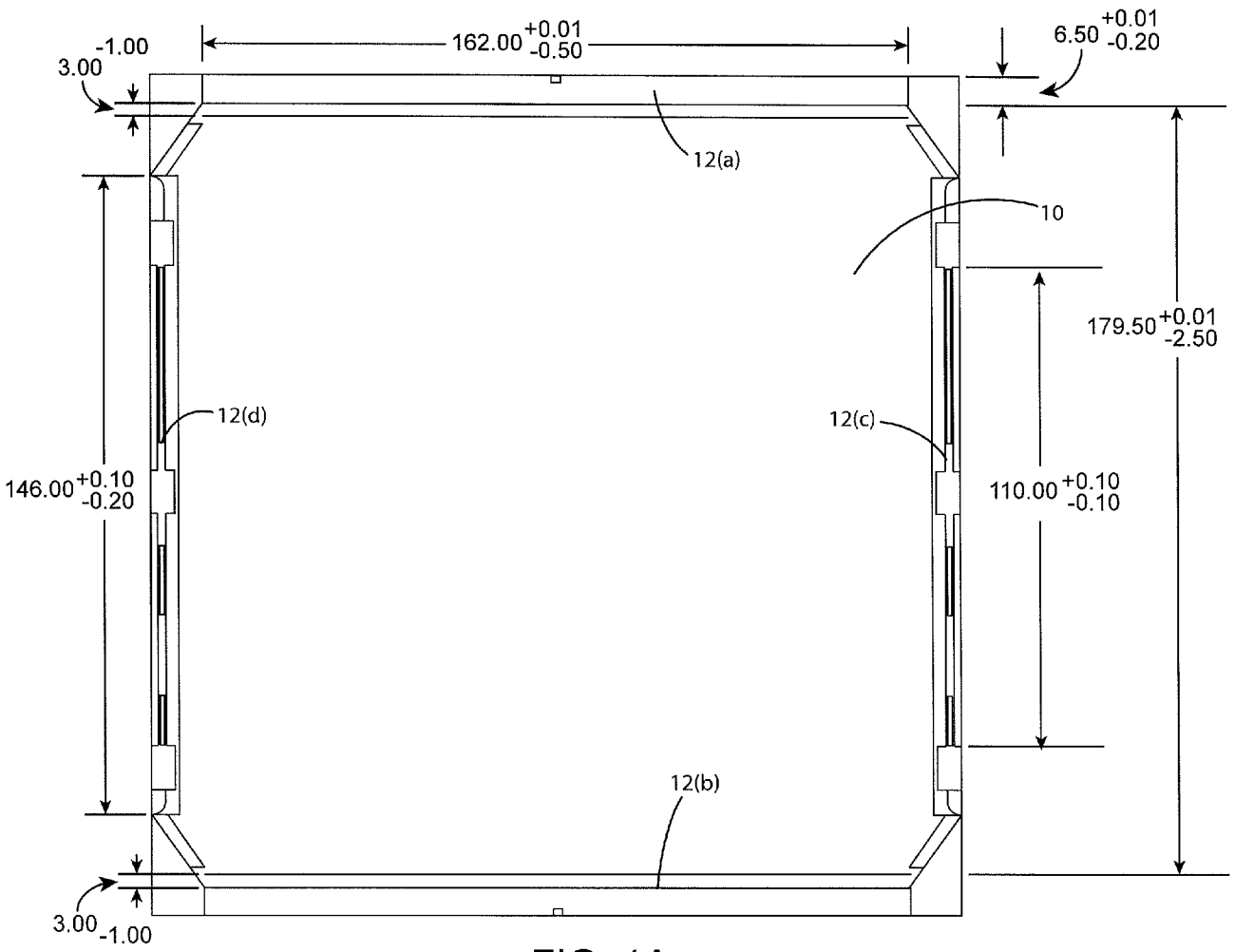
FIG. 1A shows a flat version drawing of a fabric subassembly according to embodiments of the invention.
Figure 1B:
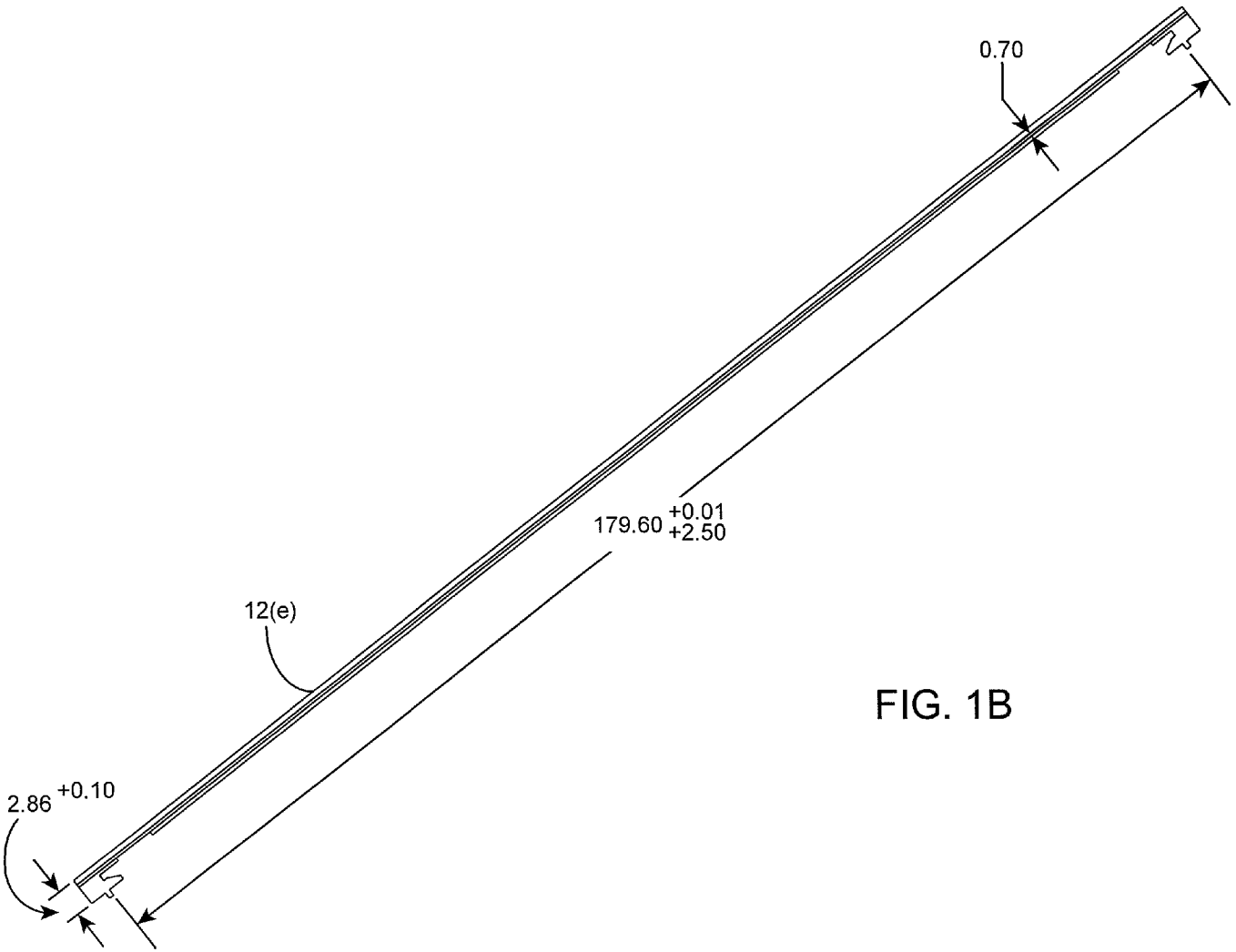
FIG. 1B shows a flat version drawing of a fabric subassembly according to embodiments of the invention.
Figure 1C:
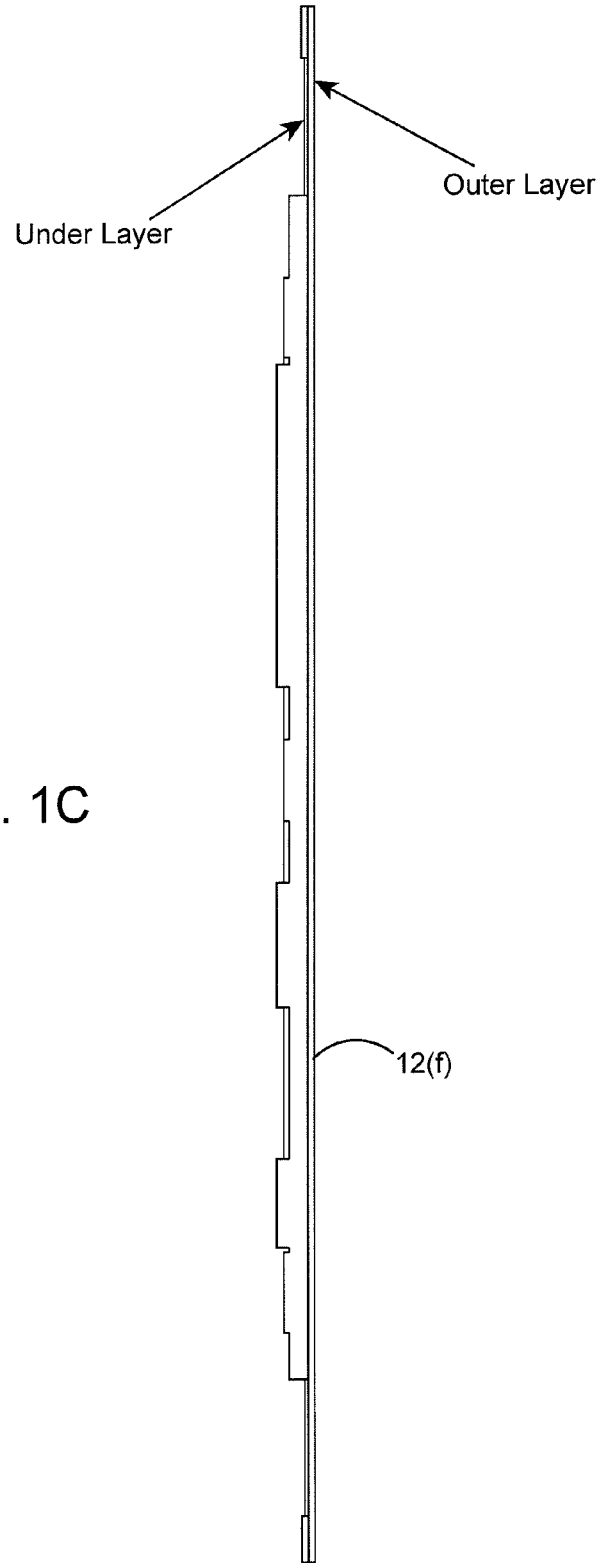
FIG. 1C shows a flat version drawing of a fabric subassembly according to embodiments of the invention.

FIG. 1A shows a flat version drawing of a fabric subassembly according to an embodiment of the invention. The dimensions shown are for exemplary purposes, it is understood that embodiments of the invention can have different dimensions (e.g., longer or shorter dimensions, etc.). Likewise, for exemplary purposes a rectangular shape is shown, it is understood that different shapes may be used depending on the shape desired for the final product (e.g., triangular shape, square shape, etc.). A fabric portion 10 is shown with a frame strip 12(*a*)-12(*d*) adhered to each edge of the fabric portion 10. The frame strips 12(*a*)-12(*d*) may be made of a plastic substrate or spring steel, etc. The frame strips 12(*a*)-12(*d*) may be adhered to the fabric portion 10 by any commonly known method (e.g., glued, bonded, polyurethane casting, injection molding frame strips directly onto fabric, etc.). Frame strips 12(*a*) and 12(*b*) may be one type of frame strip and frame strips 12(*c*) and 12(*d*) may be a second type of frame strips. For example, frame strips 12(*a*) and 12(*b*) may be the frame strip 12(*e*) shown in FIG. 1B. The frame strip 12(*e*) shown in FIG. 1B may be made of clear plastic. In another example, frame strips 12(*c*) and 12(*d*) may be the frame strip 12(*f*) shown in FIG. 1C.

The fabric portion 10 may be any fabric or flexible material. For speaker related applications the fabric portion 10 is generally acoustically transparent to allow sound to pass through the fabric. Preferably the fabric portion 10 would not decrease any acoustic performance, or at least allow for as little sound reduction as possible. A positive tactile feedback of the fabric portion 10 may also be important for the user experience. It may be better to have fabric that does not feel too sharp or too metallic or too soft. The fabric portion 10 may be configured to be wrapped around a component housing such as a cylindrical shaped speaker housing. The fabric portion 10 may be configured to wrap around the entire speaker housing to substantially cover the entire speaker housing. The fabric portion 10 may be one single piece of fabric. The fabric portion 10 may be configured to cover a non-planar area.

Figure 2:
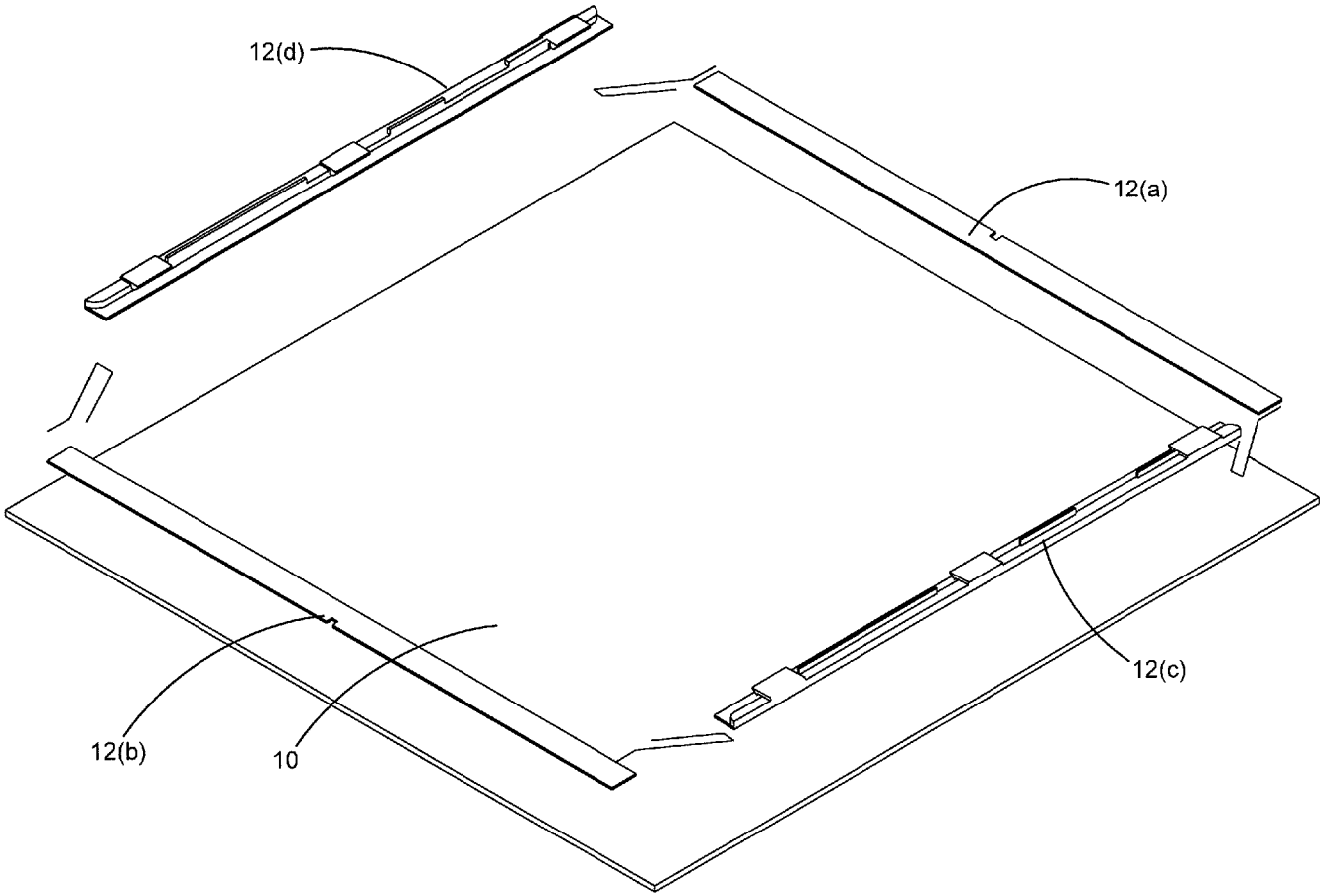
FIG. 2 shows a flat version drawing of a fabric subassembly according to embodiments of the invention.
Figure 3:
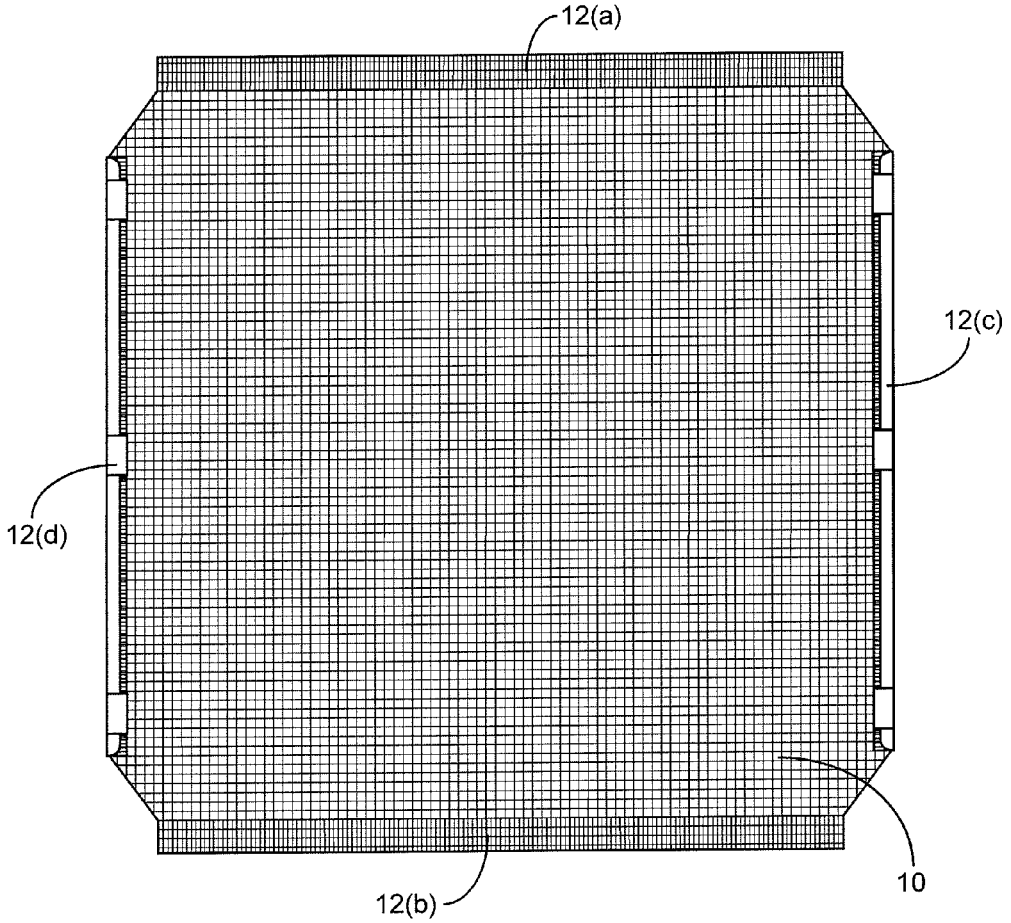
FIG. 3 shows a drawing of a fabric layout with frame strips according to embodiments of the invention.

FIG. 2 shows how the frame strips 12(*a*)-12(*d*) are placed on the fabric portion 10. As explained above, the frame strips 12(*a*)-12(*d*) may be adhered to the fabric portion 10 in any commonly known manner. FIG. 3 shows the frame strips 12(*a*)-12(*d*) adhered to the fabric portion 10. The process of adhering the frame strips 12(*a*)-12(*d*) onto the fabric portion 10 may be automated or manual. In one embodiment the frame strips 12(*a*)-12(*d*) may be six millimeters in width, as an example, other sizes may be used.

The fabric portion 10 with the adhered frame strips 12(*a*)-12(*d*) may be used to cover a speaker housing as shown in FIGS. 4-13. The speaker housing may be comprised of a plastic substrate. The speaker housing may be configured to house speaker components therein. The speaker components may be positioned substantially within the housing. Exemplary speaker components may include at least one driver, control circuitry, connectivity circuitry, and a power source. One or more of the speaker components may be external to the housing. The power source may include a battery, and/or circuitry to connect to an external power source (e.g., an electric outlet). The driver can refer to a device that converts electrical signals from an electrical source into sound for a listener. The speaker components may optionally include a microphone.

Figure 4:
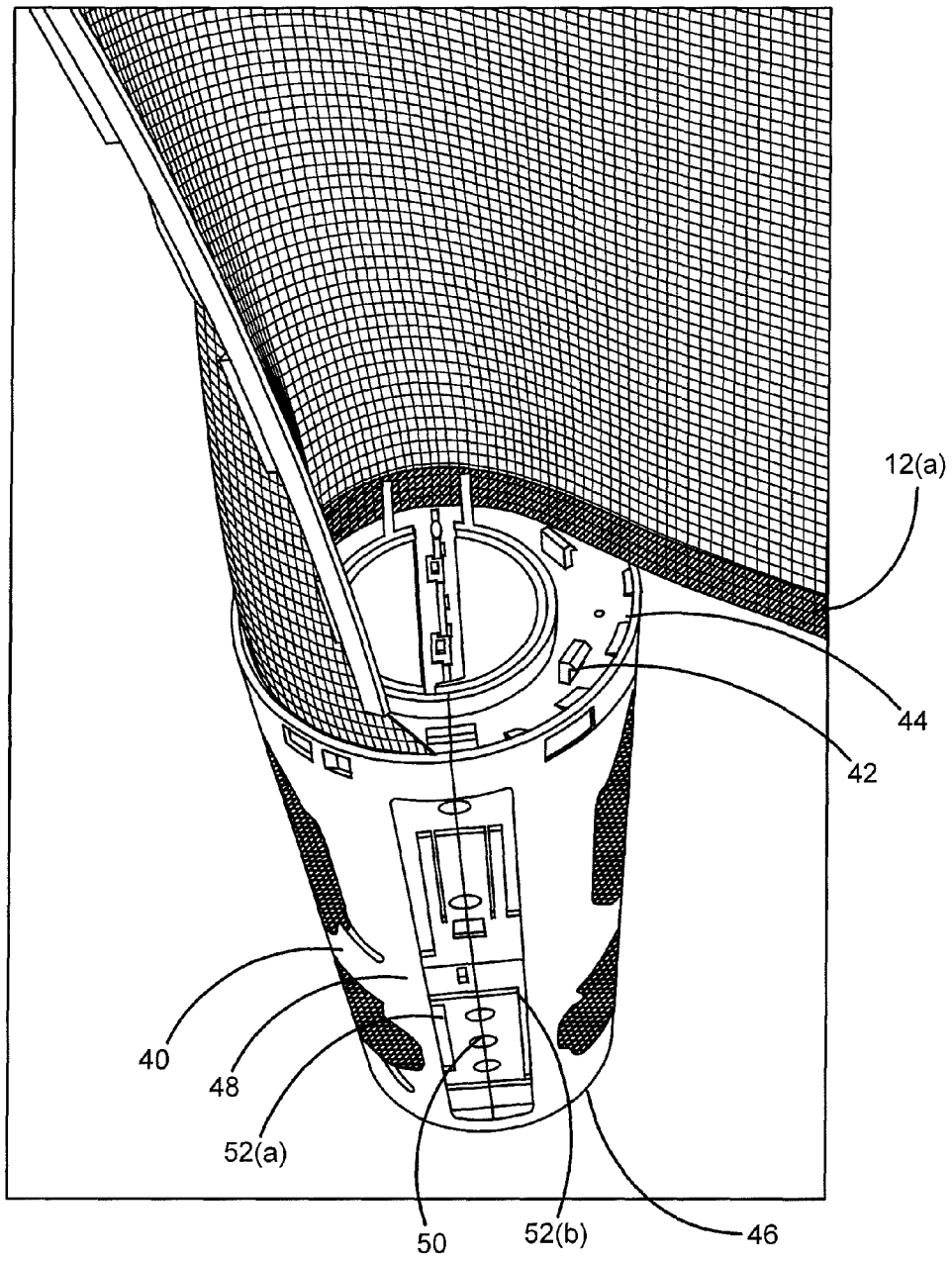
FIGS. 4-12 show drawings of a speaker fabric assembly.

As shown in FIG. 4 the speaker housing 40 may be a cylinder shape, however, it is understood that other shapes may be used as desired (e.g., triangular shape, rectangular shape, square shape, etc.). The speaker housing 40 may comprise a first end 42 comprising a first fastening mechanism (e.g., shoulder 44) that goes around the edge of the first end 42. The speaker housing 40 may comprise a second end 46 comprising a second fastening mechanism (e.g., shoulder 54 (not shown)) that goes around the edge of the second end 46.

The speaker housing 40 may also comprise a main body 48 comprising a recess 50 and a first main body fastening mechanism (e.g., shoulder 52(*a*)) and a second main body fastening mechanism (e.g., shoulder 52(*b*)).

Figure 5:
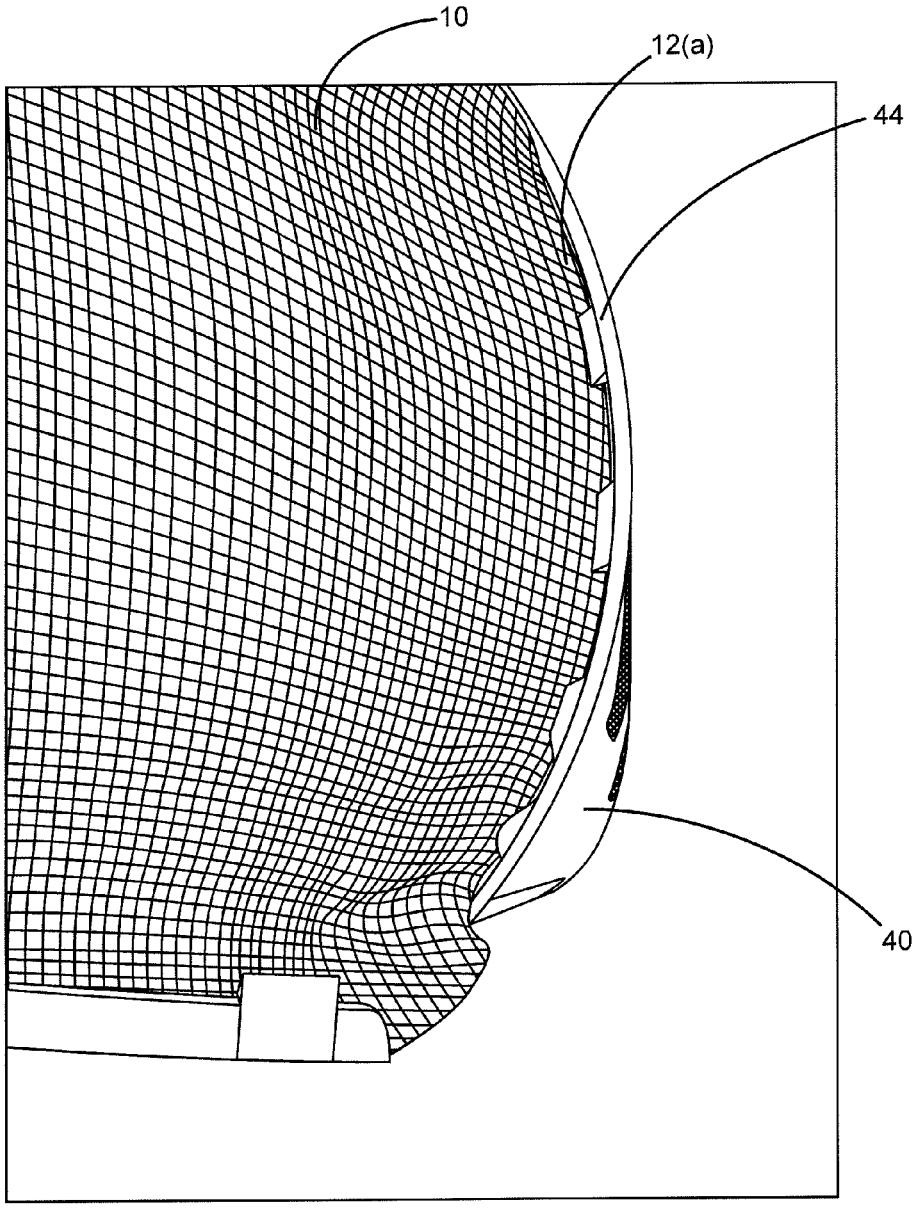

After adhering the frame strips 12(*a*)-12(*d*) to the fabric portion 10, the fabric portion 10 may be assembled onto the speaker housing 40. As shown in FIG. 4, a first frame strip 12(*a*) may be placed or tucked under the shoulder 44 on a first end 42 of the speaker housing 40. The first frame strip 12(*a*) may be placed or tucked all the way around the shoulder 44 on the first end 42 of the speaker housing 40 in a single motion or in stages. A close up of this is shown in FIG. 5.

Figure 6:
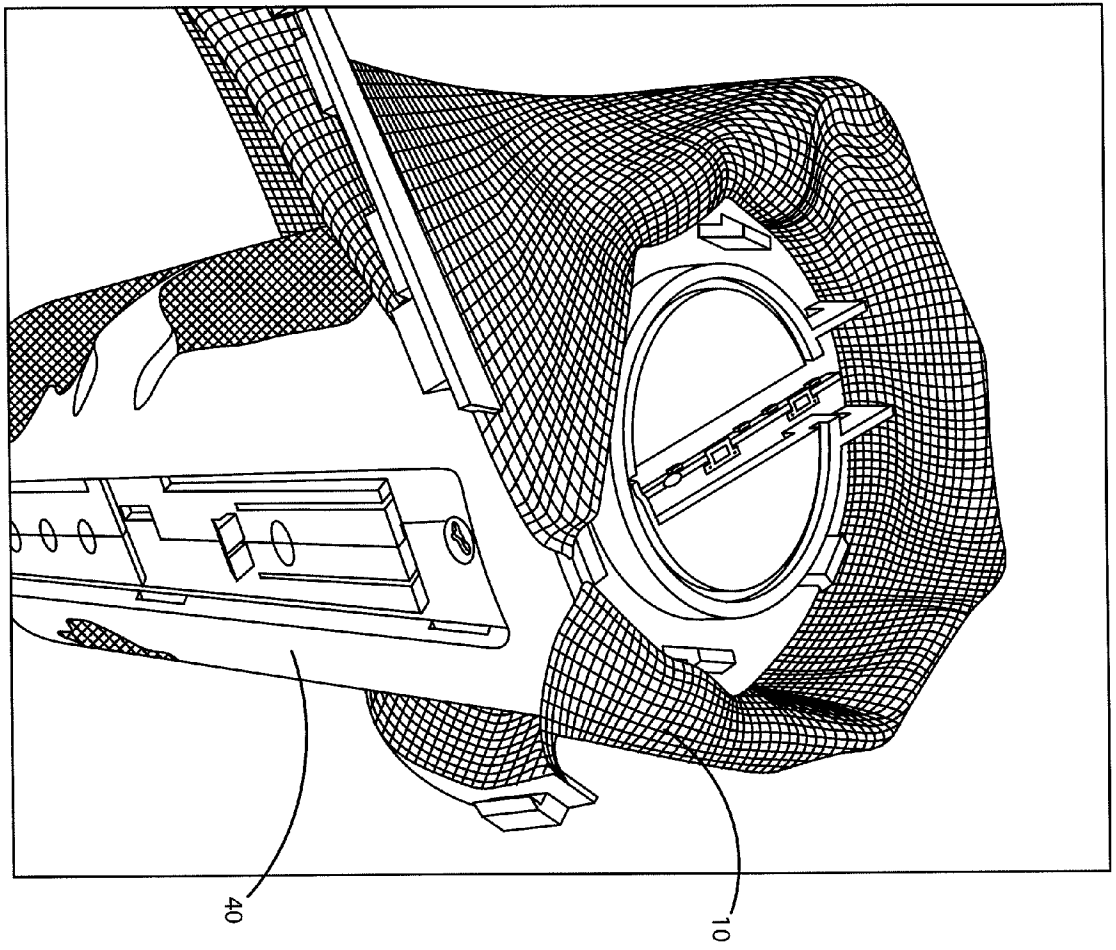
Figure 7:
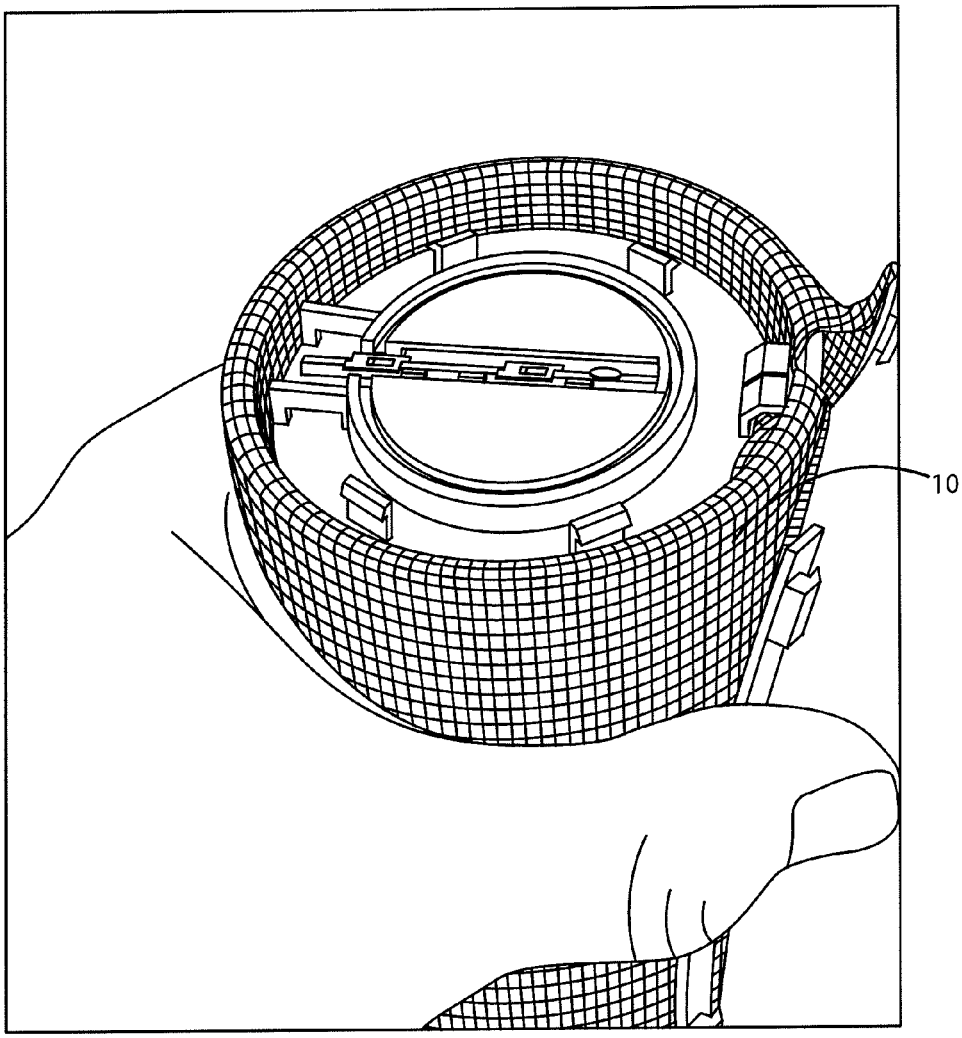
Figure 8:
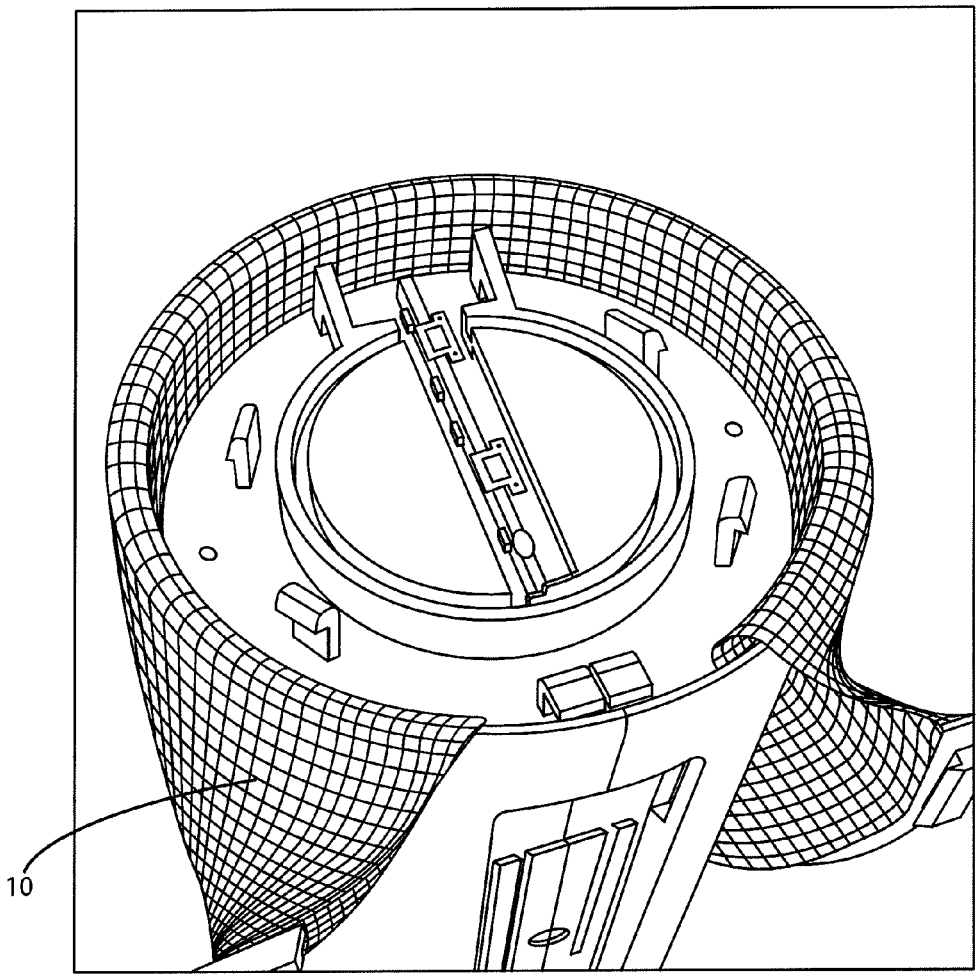

As shown in FIG. 6, the fabric portion 10 may then be laid over the speaker housing 40. The fabric portion 10 may then be pulled down towards a second end of the speaker housing 40 as shown in FIG. 7 and FIG. 8.

Figure 9:
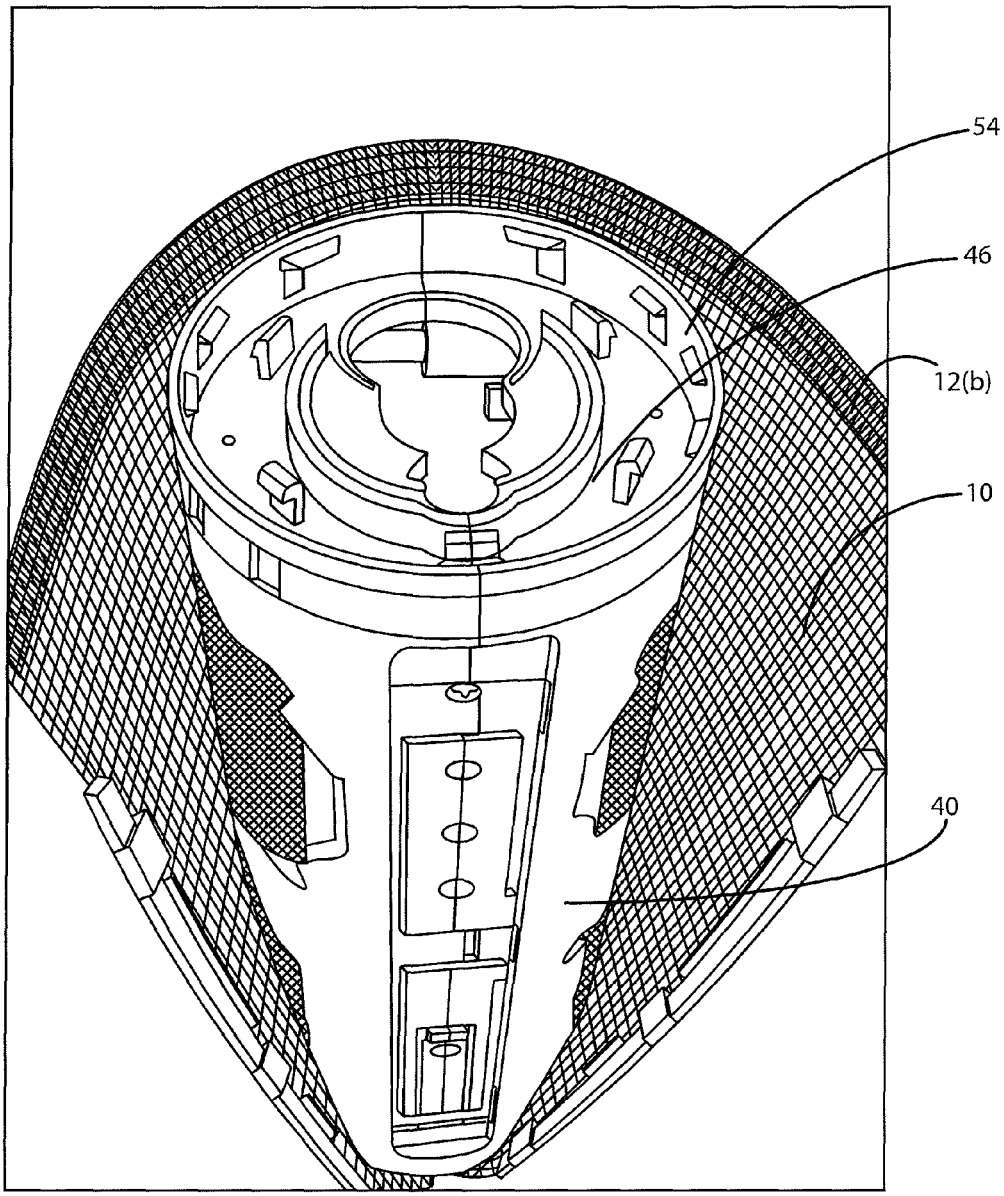
Figure 10:
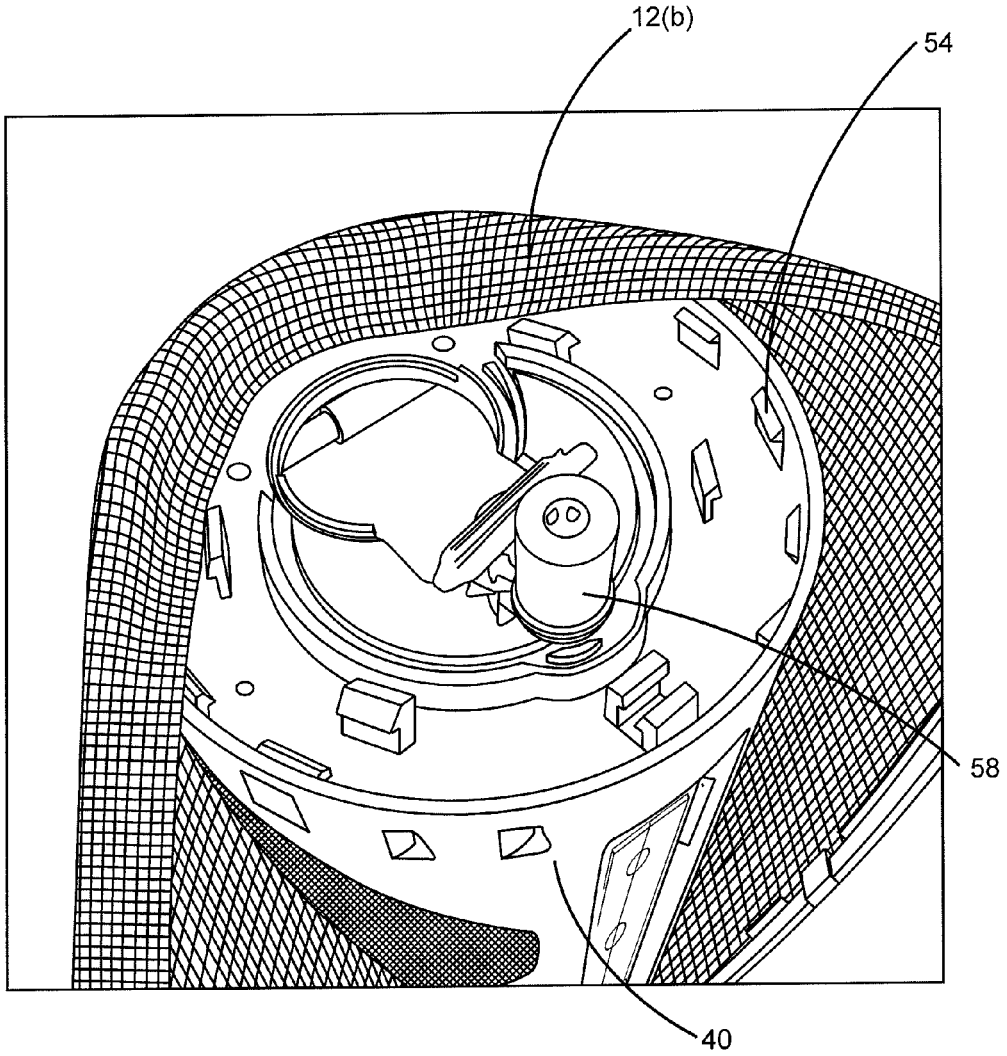

The speaker housing 40 may then be rotated to do the second end 46 of the speaker housing 40, as shown in FIG. 9. In some embodiments the speaker housing 40 may be aligned in other orientations during the application of the fabric portion 10. As shown in FIG. 10, the second frame strip 12(*b*) may be placed or tucked into the shoulder 54 on the second end 46 of the speaker housing 40. The second frame strip 12(*b*) may be placed or tucked all the way around the shoulder 54 on the second end 46 of the speaker housing 40. The second end 46 of the speaker housing 40 may contain a cavity to hold a battery 58. The battery, or other components stored in the end portions of the speaker housing 40, may be left out to allow for easier assembly of fabric on the second end 46 of the speaker housing 40. Similar components may be stored in the first end 42 of the speaker housing 40.

Figure 11:
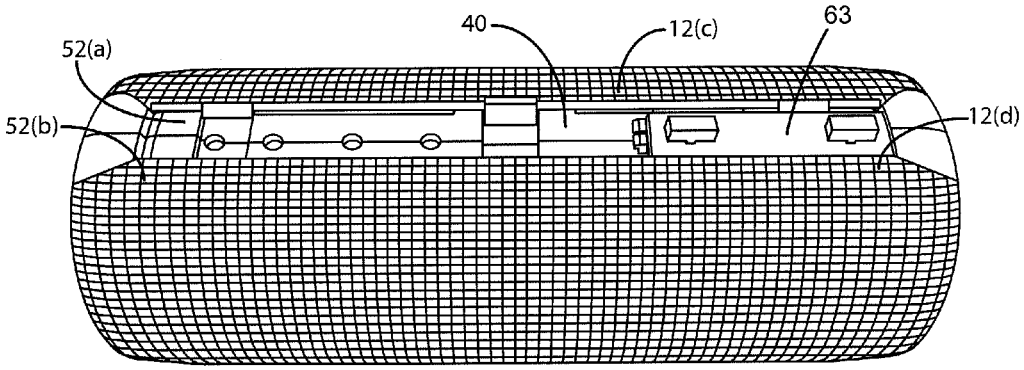

Next, the third frame strip 12(*c*) and the fourth frame strip 12(*d*) may be each placed or snapped into the speaker housing 40 as shown in FIG. 11. The third frame strip 12(*c*) may be placed under or snapped into a first main body shoulder 52(*a*) and the fourth frame strip 12(*d*) may be placed under or snapped into a second main body shoulder 52(*b*). An insert 63 may be placed on the main body 40. The insert 63 may include two raised buttons to include controls such as buttons for volume control.

Figure 12:
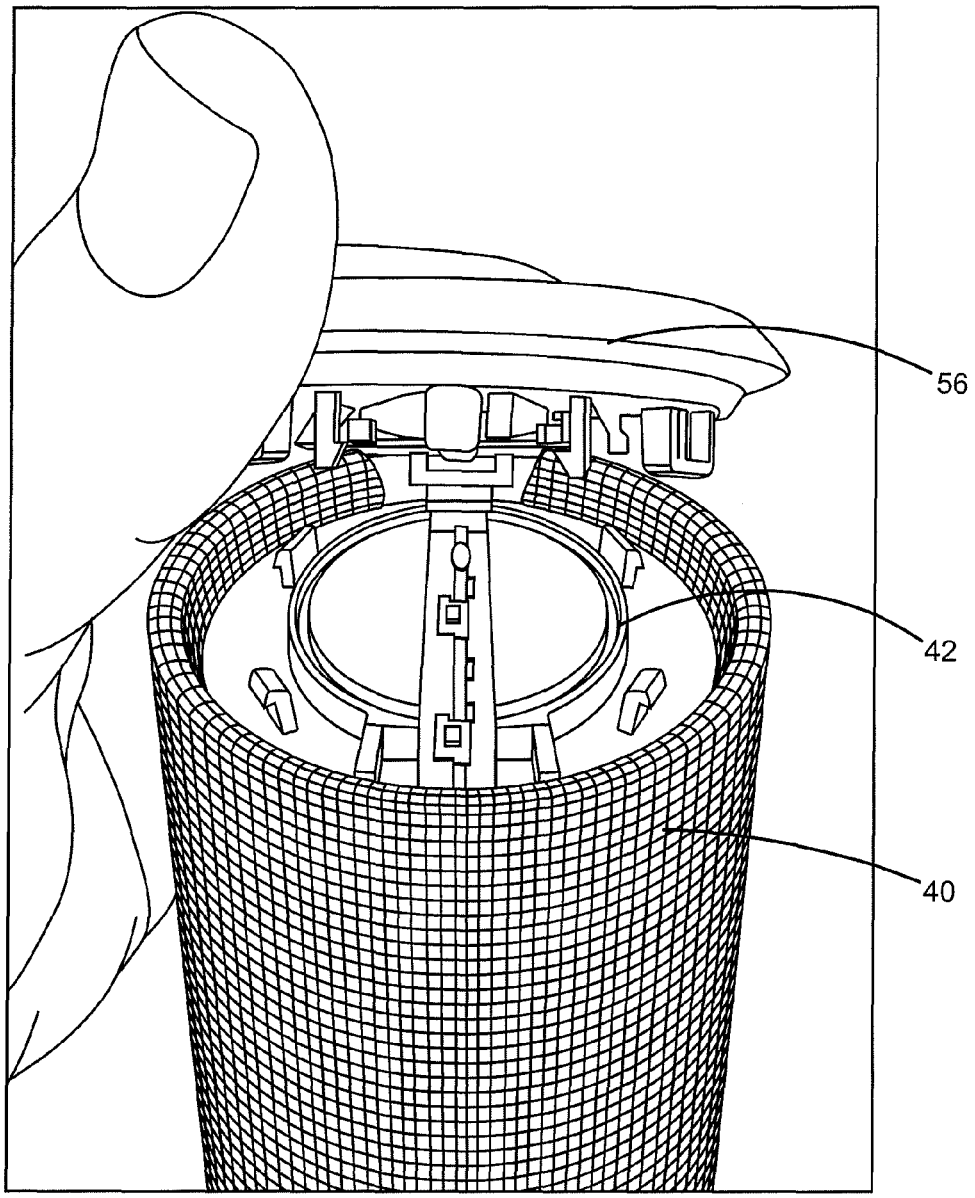

A cover piece or cap may then be placed in the recess to cover the edges (not shown). A cover piece or cap 56 may then be placed on each of the first end 42 and second end 46 of the speaker housing 40, as shown in FIG. 12. Once everything is tucked in, the tension of the fabric portion 10 prevents the fabric from coming off of the speaker housing 40. The cover pieces or caps are used to cover the edge, and they may operate to retain the cover strips in their desired positions.

Controls, connectors, and/or interfaces may be provided on one or more of the cover pieces or caps. Exemplary controls may include volume, power, etc. Exemplary connectors may include an interface to plug in a power cable, an interface to plug in a portable device such as an audio source device (e.g., MP3 player, smart phone, laptop, touch pad, computer, etc.). A display may also be provided on one or more of the cover pieces.

Accordingly an end product may be a speaker comprising a speaker housing for housing speaker components therein. The speaker housing may comprise a first end comprising a first fastening mechanism (e.g., shoulder) and a second end comprising a second fastening mechanism (e.g., shoulder). The speaker housing may further comprise a main body coupled with the first end and the second end, the main body comprising a first main body fastening mechanism (e.g., shoulder) and a second main body fastening mechanism (e.g., shoulder). A fabric portion may be coupled with the speaker housing, the fabric portion comprising a first edge, a second edge, a third edge, and a fourth edge. The fabric portion may further comprise a first frame strip coupled with the first edge, a second frame strip coupled with the second edge, a third frame strip coupled with the third edge, and a fourth frame strip coupled with the fourth edge. The fabric portion may coupled with the speaker housing via the first frame strip of the fabric portion and the first fastening mechanism (e.g., shoulder) of the speaker housing, the second frame strip of the fabric portion and the second fastening mechanism (e.g., shoulder) of the speaker housing, the third frame strip of the fabric portion and the first main body fastening mechanism (e.g., shoulder) of the speaker housing, and the fourth frame strip of the fabric portion and the second main body fastening mechanism (e.g., shoulder) of the speaker housing.

The fabric portion of the speaker may be under tension in multiple directions due to the fabric portion being coupled with the speaker housing. For example, the fabric portion of the speaker may be under tension in multiple directions due to the fabric portion being coupled with the speaker housing via the first frame strip of the fabric portion and the first shoulder of the speaker housing, the second frame strip of the fabric portion and the second shoulder of the speaker housing, the third frame strip of the fabric portion and the first main body shoulder of the speaker housing, and the fourth frame strip of the fabric portion and the second main body shoulder of the speaker housing. The fastening mechanism may allow stretching of the fabric portion when coupled with the speaker to apply tension to the fabric portion.

Figure 13:
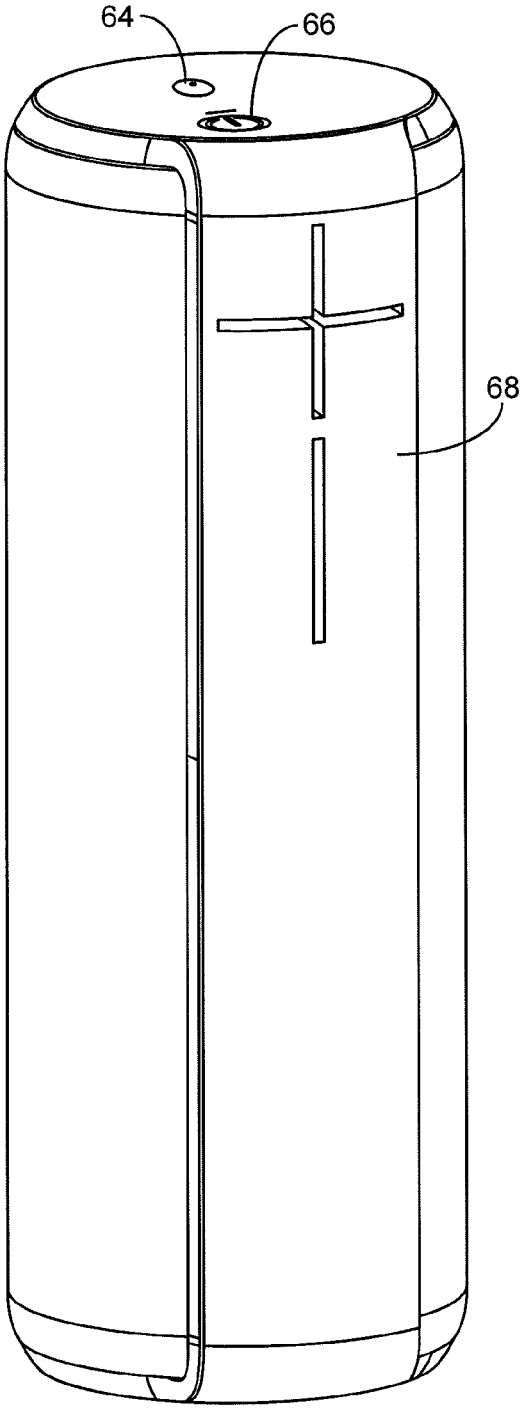
FIGS. 13-21 show drawings of a covered housing.
Figure 14:
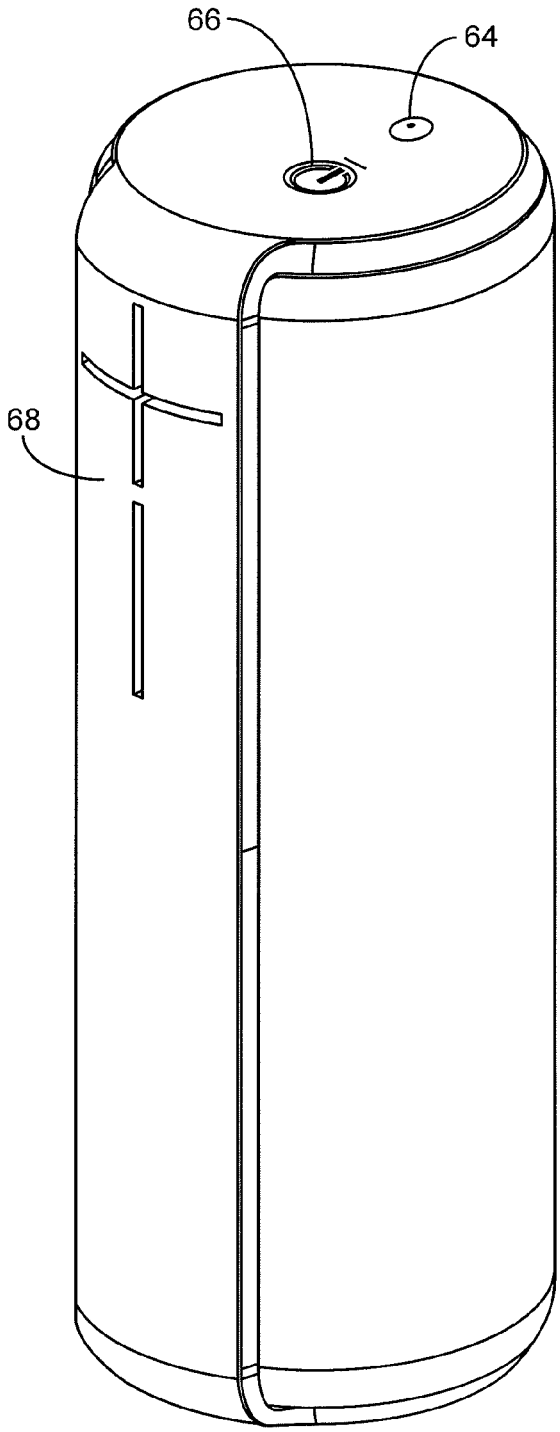
Figure 15:
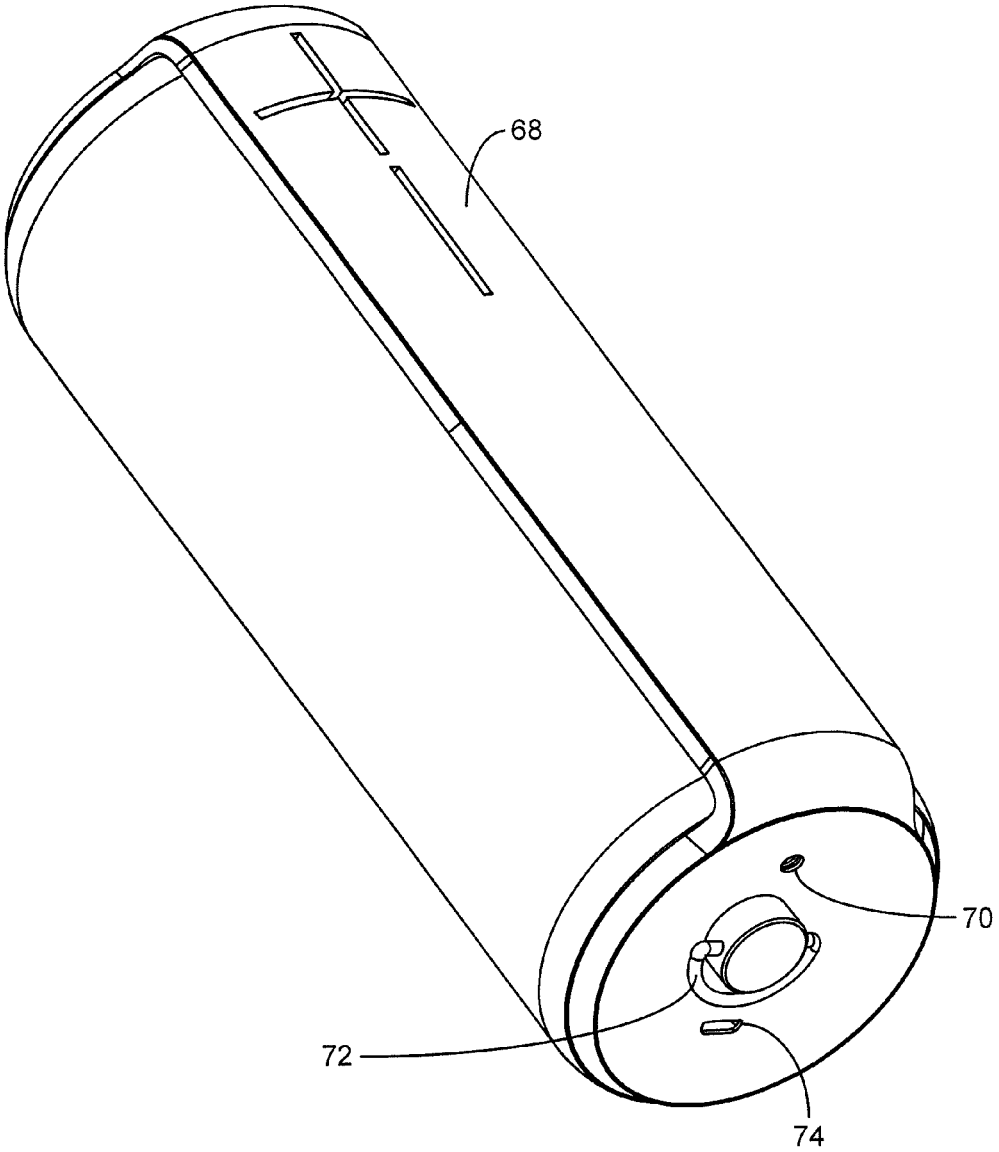
Figure 16:
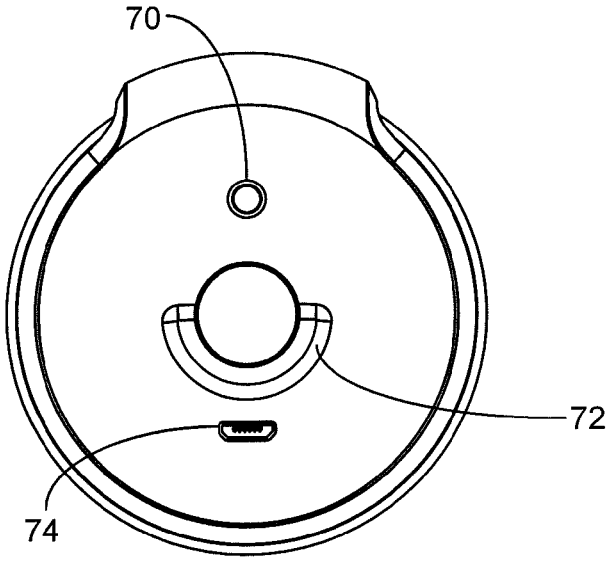
Figure 17:
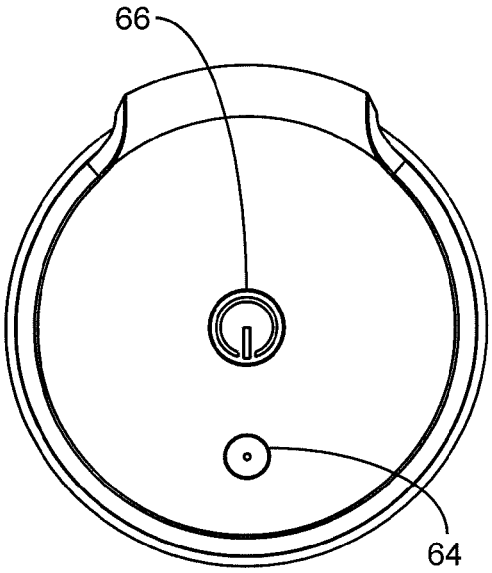
Figure 18:
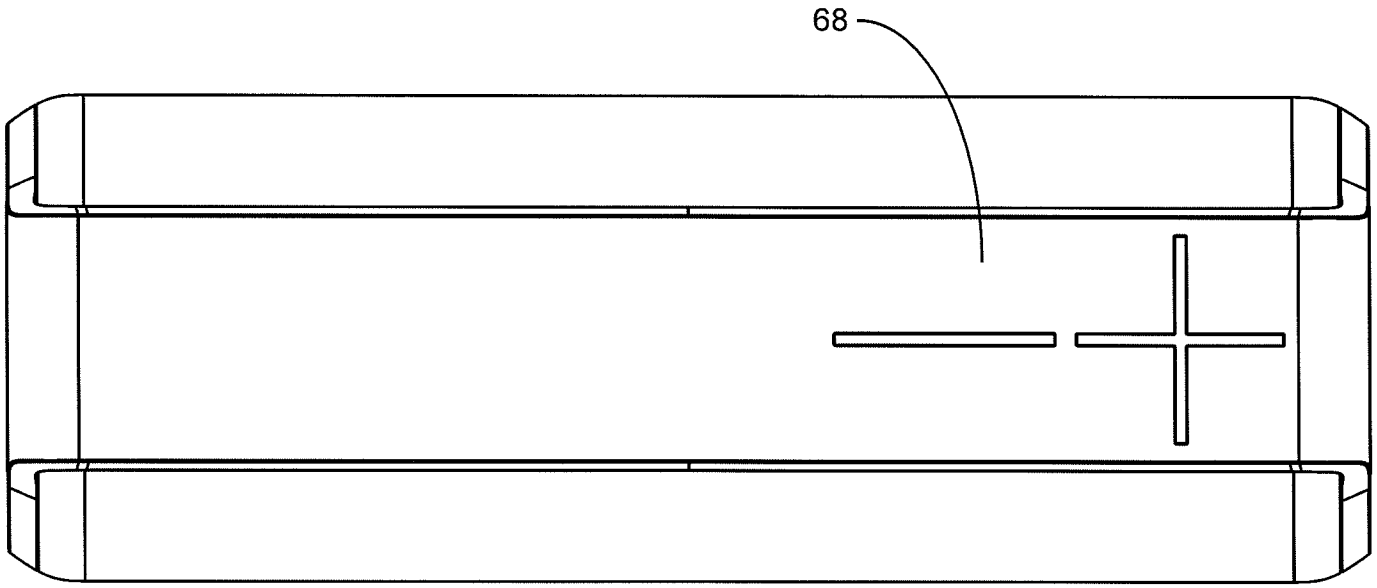
Figure 19:
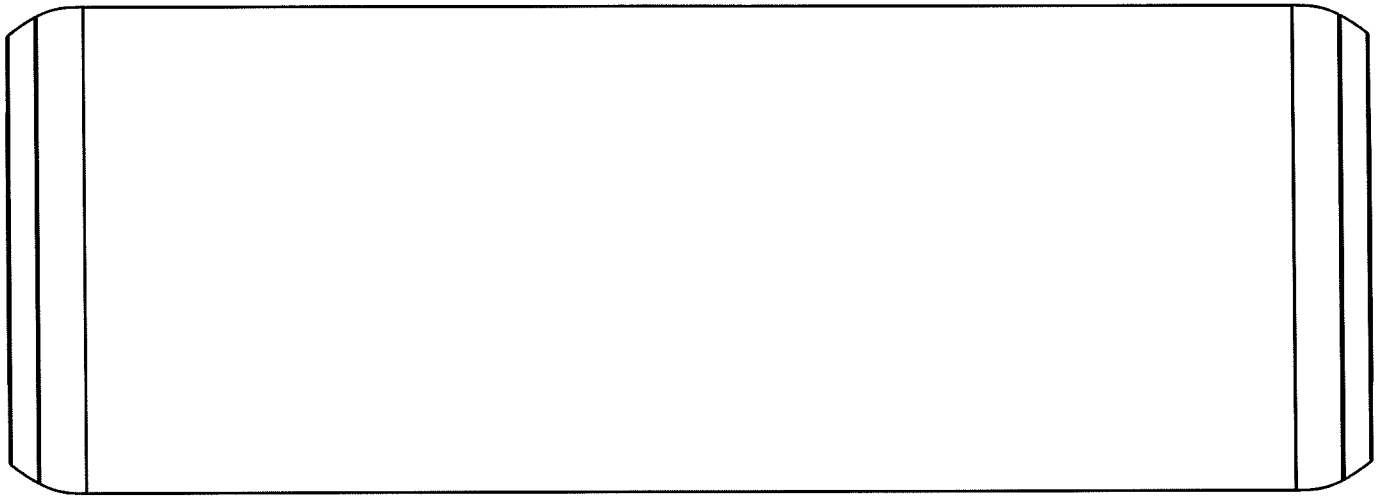
Figure 20:
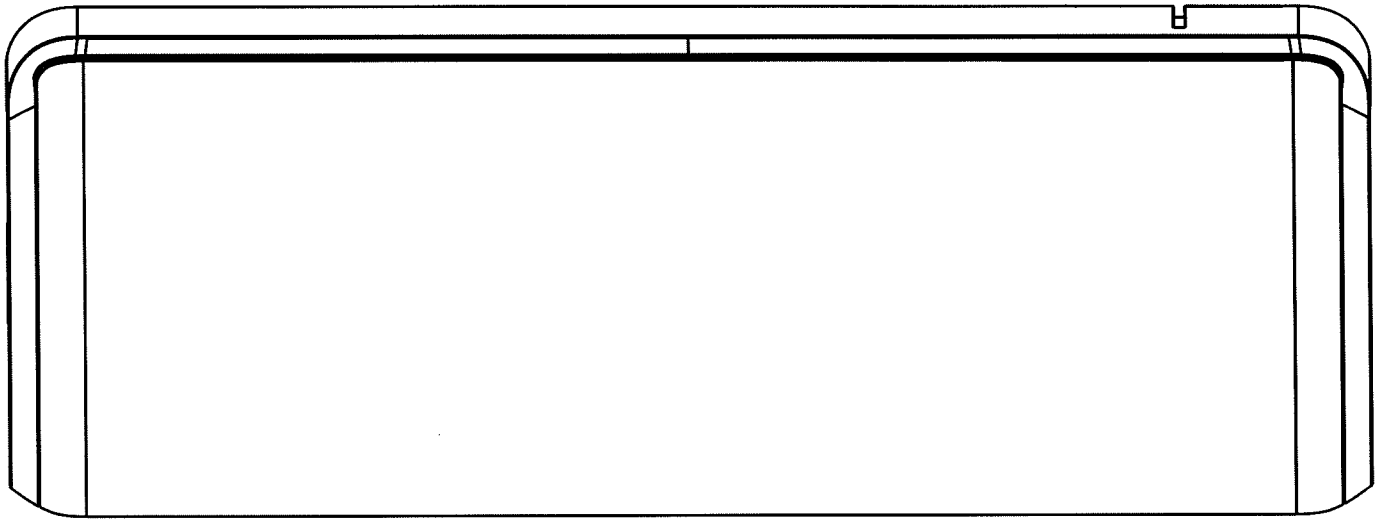
Figure 21:
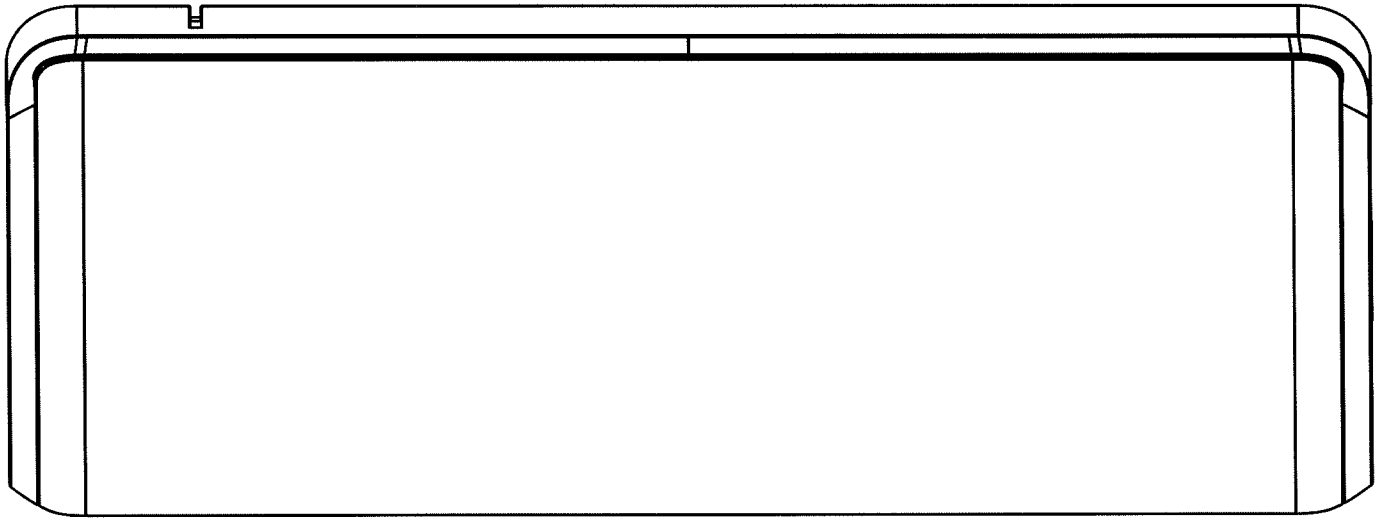

An exemplary end product is shown in FIGS. 13-21. FIG. 13 shows a perspective view of a covered housing in the form of a speaker. The speaker may include a button 64, a button 66 and controls 68. FIG. 14 shows another view of a speaker. The speaker may include a button 64, a button 66 and controls 68. FIG. 15 shows another view of a speaker. The speaker may include controls 68, a jack 70, a D-ring 72 and an input port 74. FIG. 16 shows a bottom view of a speaker. The speaker may include a jack 70, a D-ring 72 and an input port 74. FIG. 17 shows a top view of a speaker. The speaker may include a button 64 and a button 66. FIG. 18 shows a front view of a speaker. The speaker may include controls 68. FIG. 19 shows a back view of a speaker. FIG. 20 shows a right view of a speaker. FIG. 21 shows a left view of a speaker.

Embodiments of the invention provide for a number of advantages. For example, embodiments are particularly advantageous for cylindrical shaped components because it is difficult to create tension in the x-y direction (tension both vertically and horizontally around the cylindrical shaped component) for a cylindrical shape. One big challenge is to control the fabric tension in x-y direction after fabric is assembled to a cylindrical shape. The tension needs to be high enough so that the fabric cannot simply be pulled off the cylindrical shape. Accordingly, a traditional sock assembly where a fabric sock that is open on both ends is slipped over a rectangular or cylinder shape would not work because the tension of the sock cannot be well controlled. For example, since a sock can only be clamped at the open ends, it does not allow control of the tension in the other direction (e.g., the sock may either hang loose or bow in). Moreover, using a traditional sock assembly may require a cap on each end with a plastic piece to secure the sock in place. This may not allow for additional features or controls (e.g., buttons, etc.) or connectors on the ends of the speaker housing because of the constrained space due to the mechanism used to secure the sock in place. This may be especially an issue with portable-type speakers that have limited space for controls. Embodiments of the invention create tension in the x-y direction so that frame strips bonded to the fabric that are tucked under shoulders of a speaker housing. Once the fabric strips are secured under the shoulders, the fabric does not pop out of place thereby holding the fabric in the intended position and shape. Thus, the fabric assembly creates tension such that the fabric is held into place on the housing.

Moreover, since a cap is not required on each end to hold the fabric in place, the spaces on each end can be utilized for controls, connectors and other features. This is particularly advantageous with small portable speakers which have limited space for controls.

In another example of advantages, embodiments of the invention also allow for one piece of fabric to cover the housing without any visible wrinkles. This makes assembly and manufacturing easier and cost effective and also allows for a nice looking product since only fabric on the outside of the housing is visible, without any seams or wrinkles.

The foregoing description is intended to be illustrative, but not limiting, of the scope of the invention which is set forth in the following claims. As can be understood by those of skill in the art, the present invention may be embodied in other specific forms without departing from the essential characteristics thereof.

What is claimed is:

1. A process for assembly of a fabric covered speaker housing comprising:

providing a substantially rectangular fabric with first, second, third and fourth linear frame strips attached proximate first, second, third and fourth edges, respectively, of the substantially rectangular fabric;

providing a speaker housing at least partially curved in shape, with first and second ends, the first end having a first shoulder extending around substantially all of the first end adjacent a periphery of the first end, and the second end having a second shoulder extending around substantially all of the second end adjacent a periphery of the second end;

the speaker housing further including first and second main body shoulders, extending along a portion of the length of the at least partially curved speaker housing, such that a majority of the surface of the at least partially curved speaker housing is between the main body shoulders in a first direction;

placing the first frame strip under the first shoulder on the first end of a housing;

placing the second frame strip under the second shoulder on the second end of the speaker housing, so that the fabric is stretched and under tension between the first and second ends;

placing the third frame strip under the first main body shoulder of the housing; and placing the fourth frame strip under the second main body shoulder of the housing, so that the fabric is stretched and under tension between the first and second main body shoulders.

2. The process of claim 1 wherein the first frame strip is placed all the way around the shoulder on the first end of the housing.

3. The process of claim 1 wherein the second frame strip is placed all the way around the shoulder on the second end of the housing.

4. The process of claim 1 further comprising placing a first cover piece on the first end of the housing and a second cover piece on the second end of the speaker housing.

5. The process of claim 4 wherein the first cover includes at least one control for a speaker.

6. The process of claim 4 wherein the first cover includes at least one connector.

7. The process of claim 1 further comprising placing a third cover piece in a recess on a main body of the housing.

8. The process of claim 1 wherein the fabric portion is acoustically transparent.

9. The process of claim 1 wherein the fabric portion has a positive tactile feedback.

10. The process of claim 1 further comprising adhering each of the frame strips to an edge of the fabric portion.

11. A speaker comprising:

a speaker housing for housing speaker components therein, the speaker housing being at least partially curved in shape;

the speaker housing comprising a first end comprising a first end shoulder, the first end shoulder extending around substantially all of the first end adjacent a periphery of the first end;

the speaker housing further comprising a second end comprising a second end shoulder, the second end shoulder extending around substantially all of the second end adjacent a periphery of the second end;

the speaker housing further comprising a main body coupled with the first end and the second end, the main body comprising a first main body shoulder and a second main body shoulder extending perpendicular to the first and second ends;

a substantially rectangular fabric portion coupled with the speaker housing, the fabric portion comprising a first edge, a second edge, a third edge, and a fourth edge;

the fabric portion further comprising a first frame strip attached adjacent the first edge, a second frame strip attached adjacent the second edge, a third frame strip attached adjacent the third edge, and a fourth frame strip attached adjacent the fourth edge; and the fabric portion secured to the speaker housing via the first frame strip of the fabric portion and the first shoulder of the speaker housing, the second frame strip of the fabric portion and the second shoulder of the speaker housing, the third frame strip of the fabric portion and the first main body shoulder of the speaker housing, and the fourth frame strip of the fabric portion and the second main body shoulder of the speaker housing, such that the fabric is stretched by the third and fourth frame strips and in tension in a first direction between the first and second main body shoulders, and the fabric is stretched by the first and second frame strips and in tension in a second direction between the first and second end shoulders.

12. The speaker of claim 11 wherein the speaker components comprise at least one driver, control circuitry, connectivity circuitry and a power source.

13. The speaker of claim 11 further comprising a first cover piece coupled with the first end of the speaker housing.

14. The speaker of claim 13 wherein the first cover piece includes at least one control for the speaker.

15. The speaker of claim 13 wherein the first cover piece includes at least one connector or interface.

16. The speaker of claim 11 further comprising a second cover piece coupled with the second end of the speaker housing.

17. The speaker of claim 11 wherein the speaker housing further comprises a recess.

18. The speaker of claim 17 further comprising a third cover piece coupled with the recess of the speaker housing.

19. The speaker of claim 11 wherein the fabric portion is a single piece of fabric.

20. The speaker of claim 11 wherein the first frame strip, the second frame strip, the third frame strip and the fourth frame strip are glued to the fabric portion.

21. The speaker of claim 11 wherein the first frame strip, the second frame stipe, the third frame strip, and the fourth frame strip are made of a plastic substrate or spring steel.

22. The speaker of claim 11 wherein the first frame strip is coupled with the first edge, the second frame strip is coupled with the second edge, the third frame strip is coupled with the third edge, and the fourth frame strip is coupled with the fourth edge by being adhered to the fabric portion.

23. The speaker of claim 11 wherein the fabric portion is secured to the speaker housing via the first frame strip of the fabric portion and the first shoulder by the first frame strip being placed or tucked under the first shoulder.

24. A speaker comprising:

a speaker housing for housing speaker components therein, the speaker housing being at least partially curved in shape;

the speaker housing comprising a first end comprising a first end fastening mechanism;

the speaker housing further comprising a second end comprising a second end fastening mechanism;

the speaker housing further comprising a main body coupled with the first end and the second end, the main body comprising a first main body fastening mechanism and a second main body fastening mechanism;

a fabric portion coupled with the speaker housing, the fabric portion comprising a first edge, a second edge, a third edge, and a fourth edge;

the fabric portion further comprising a first frame strip coupled with the first edge, a second frame strip coupled with the second edge, a third frame strip coupled with the third edge, and a fourth frame strip coupled with the fourth edge; and the fabric portion secured to the speaker housing via the first frame strip of the fabric portion and the first fastening mechanism of the speaker housing, the second frame strip of the fabric portion and the second fastening mechanism of the speaker housing, the third frame strip of the fabric portion and the first main body fastening mechanism of the speaker housing, and the fourth frame strip of the fabric portion and the second main body fastening mechanism of the speaker housing, such that the fabric is stretched by the third and fourth frame strips and in tension in a first direction between the first and second main body fastening mechanisms, and the fabric is stretched by the first and second frame strips and in tension in a second direction between the first and second end fastening mechanisms.

* * * * *